United States Patent [19]

Adler

[11] Patent Number: 5,071,192

[45] Date of Patent: Dec. 10, 1991

[54] ADJUSTABLE SEATING APPARATUS WITH FULL TORSO SUPPORT

[76] Inventor: Lezlie J. Adler, 407 North Williamsbury, Birmingham, Mich. 48010

[21] Appl. No.: 360,436

[22] Filed: Jun. 2, 1989

[51] Int. Cl.[5] ..... A47C 31/00

[52] U.S. Cl. ..... 297/464; 297/460; 4/572

[58] Field of Search ..... 297/170, 172, 487, 488, 297/460, 464; 4/571, 572, 573, 575, 578

[56] References Cited

U.S. PATENT DOCUMENTS

| | | | |
|---|---|---|---|
| 1,256,811 | 2/1918 | McNamara . | |
| 1,327,295 | 1/1920 | Smith | 4/572 |
| 1,454,565 | 5/1923 | Sanford . | |
| 1,858,103 | 5/1932 | Menon . | |
| 2,177,998 | 10/1939 | Schuette | 4/572 |
| 2,229,411 | 1/1941 | Hughes . | |
| 2,285,900 | 6/1942 | Chapman | 4/572 |
| 2,503,938 | 4/1950 | Davis | 4/572 |
| 2,572,282 | 10/1951 | Scanlon | 297/170 X |
| 2,579,340 | 6/1953 | Corbett | 4/572 |
| 2,669,285 | 2/1954 | Young | 297/170 X |
| 2,673,595 | 3/1954 | Kump, Jr. . | |
| 2,694,438 | 11/1954 | Frech . | |
| 3,005,208 | 10/1961 | Matthews | 4/578 |
| 3,188,662 | 6/1965 | Watson . | |
| 3,499,681 | 3/1970 | Benitez et al. | 297/465 |
| 3,656,804 | 4/1972 | Nielsen . | |
| 4,632,410 | 12/1986 | Bainbridge et al. . | |
| 4,767,160 | 8/1988 | Mengshoel et al. . | |

FOREIGN PATENT DOCUMENTS

| | | | |
|---|---|---|---|
| 1009484 | 3/1952 | France | 297/172 |
| 0166141 | 7/1987 | Japan | 297/465 |

OTHER PUBLICATIONS

Columbia Medical Mfg. Corp., "Good News", Catalog (four pages), dated Jan. 1, 1989.

Columbia Company Catalog.

Advertising Sheet on Infant Seat, No. A753-1.

*Primary Examiner*—Jose V. Chen

*Attorney, Agent, or Firm*—Harness, Dickey & Pierce

[57] ABSTRACT

An adjustable seating apparatus with full torso support for supporting persons of varying sizes. The seating apparatus is portable and adjustments can be made without the use of tools. A base unit includes a number of detachable elongated members which can be replaced with different size members, permitting both the length and width of the support apparatus to be adjusted. A backrest is supported by vertical members which are also detachable to permit adjustments in the height of the backrest. The backrest also includes a restraint for securing the user to the backrest about the torso. An optional tray is also adjustable in height and provides a work surface for the user.

12 Claims, 2 Drawing Sheets

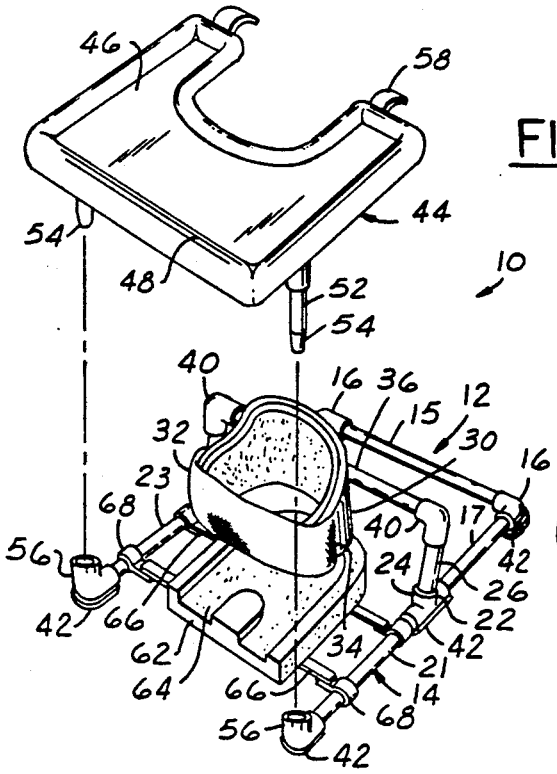
FIG. 1
FIG. 2
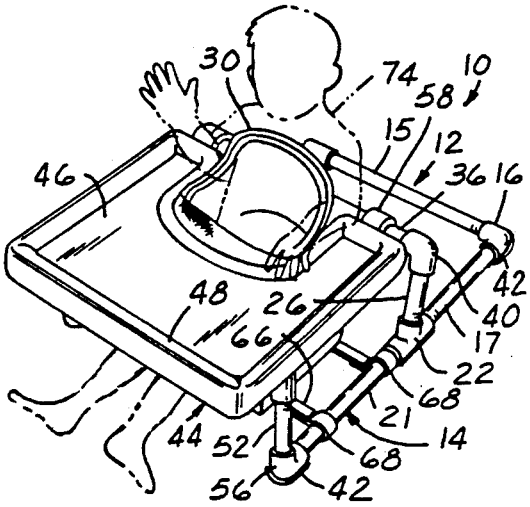
FIG. 3
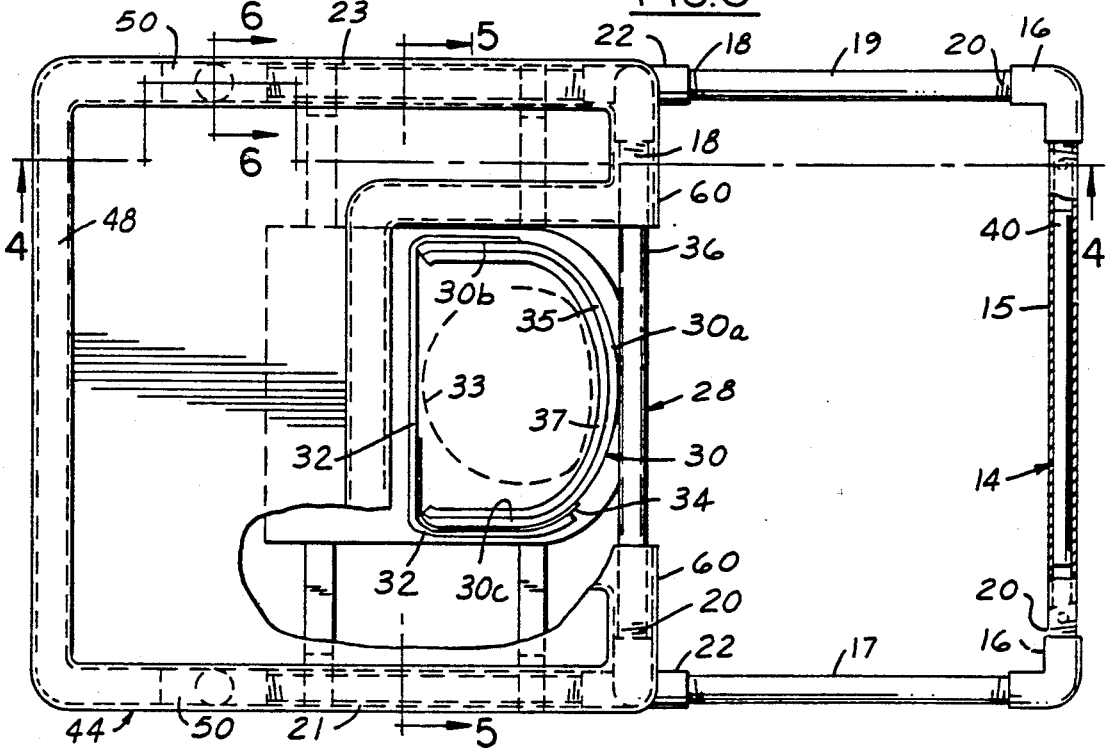

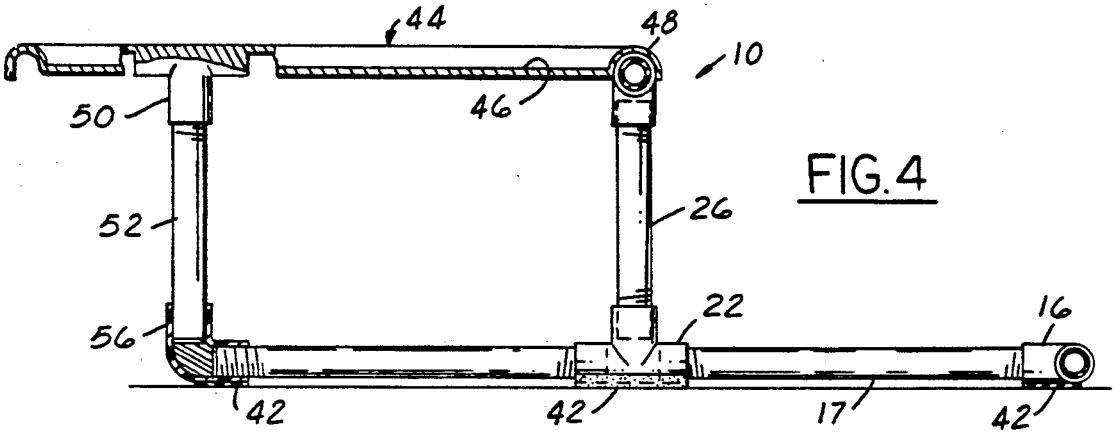
FIG.4
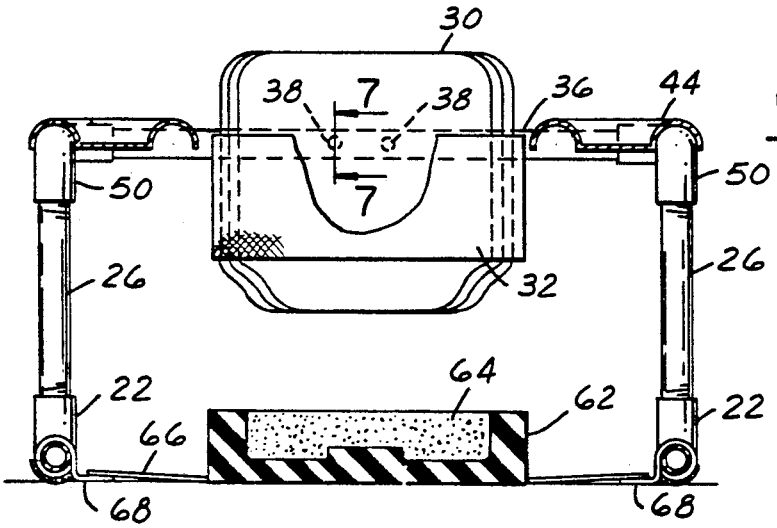
FIG.5
FIG.6
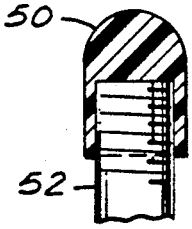
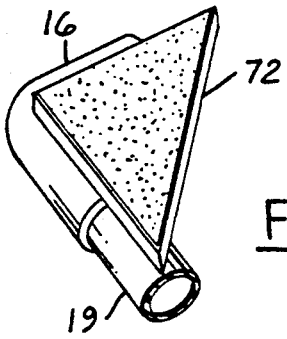
FIG.8
FIG.7
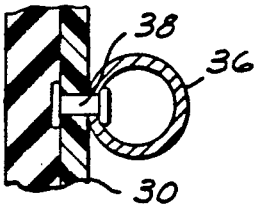

ADJUSTABLE SEATING APPARATUS WITH FULL TORSO SUPPORT

FIELD OF THE INVENTION

This invention relates generally to an apparatus for supporting the human body at the torso while seated, and in particular, to a support apparatus of the aforementioned type which can be adjusted to accommodate persons of different sizes.

BACKGROUND OF THE INVENTION

Devices for supporting a person's body by the torso are useful in many circumstances. Infants often require support to maintain a seating position because they have not yet developed the requisite strength and motor skills to maintain an upright position unassisted. In addition, older children and adults with various physical handicaps require assistance to maintain an upright position for short or extended periods of time, especially where the person must be left unattended. Bathing is one activity in which maintaining an upright position is extremely important, and even temporary loss of support must be avoided.

A number of devices have long been available to support a person's body. Many of these devices such as canes and walkers require certain coordination and strength on the part of the user. Of those devices which do not require assistance from the user, existing devices generally include a backrest and support frame for holding the person in an upright seated position.

Examples of such devices are found in the following patents:

| U.S. Pat. No. | First-Named Inventor | Issue Year |
|---|---|---|
| 1,858,103 | Menon | 1932 |
| 2,229,411 | Hughes | 1941 |
| 2,673,595 | Kump | 1954 |
| 3,656,804 | Nielsen | 1972 |

A number of body support devices are adapted for use by infants. One example is the Model No. 704 bath support, manufactured by the Columbia Company. However, when the infant grows, the apparatus becomes too small for his needs, despite the fact that the older child may still require support in certain circumstances, for example, when taking a bath. Moreover, children with significant physical handicaps may require support most of the time even as they grow to adulthood. Previous devices such as the Columbia Model No. 704 device do not adjust to accommodate persons having different size torsos. Thus it would be desirable to provide a body support apparatus which can be adjusted to snugly fit and support persons of different sizes with different size torsos. This would permit a single body support apparatus to be used by a person as that person grows. In addition, such an adjustable body support apparatus would permit a single device to be used on different persons of different sizes.

An additional disadvantage with existing body support devices is that they are generally quite rigid and only hold the torso in a single body position. Thus it would be desirable to provide a single body support apparatus which has a torso support with some flexibility to move a little and thereby more comfortably accommodate persons sitting therein as such persons attempt to lean or stretch in one direction or another.

In view of the foregoing, it is a principal object of this invention to provide body support apparatus which is adjustable to the extent that persons of a fairly wide range of sizes may use the same device. It is another object of this invention to provide a device which is easily adjustable without requiring the use of tools. It is a further object of this invention to provide an adjustable body support apparatus which is relatively inexpensive, compact, light and easily portable to facilitate multi-location usage. It is yet another object of this invention to provide a body support apparatus which can comfortably and snugly accommodate persons of different sizes as such persons lean, stretch or move their torso while seated in the apparatus.

Still another object of the present invention is to provide an adjustable seating apparatus providing full torso support that is waterproof and made of water resistant materials so that it is rugged and may be used in a variety of settings, e.g., a bathtub, a sandbox, on the lawn, etc.

SUMMARY OF THE INVENTION

In light of the foregoing problems and to fulfill a number of the foregoing objects, there is provided in accordance with the first aspect of the present invention an adjustable seating apparatus for supporting a person in a seated position with full torso support. The apparatus comprises: a base structure adapted to rest on a substantially planar support surface; a backrest structure for adjustably and encirclingly supporting the person about the torso; a frame for supporting the backrest structure; and an optional removable tray for providing a play surface at a convenient height in front of the person to be supported when such person is seated in the apparatus. The phrase "full torso support," as used herein, means to snugly and comfortably support a significant portion of a person's torso so as to allow such person to sit for extended periods of time, without significant use of the musculature of the torso, particularly the musculature of the abdomen and lower back, normally used by a person when sitting erect on a floor or chair. The base structure may include a plurality of first elongated substantially horizontally arranged support members spaced apart from one another on either side of the person to be supported. These support members may extend forwardly and rearwardly from the transverse centerline of the torso of the person so as to prevent the apparatus from tipping in either a forward or rearward direction while the person is seated in the apparatus.

The backrest structure preferably includes first and second broad flexible support members and fastening means for releasing and for adjusting the effective length of the second flexible member by at least about 50%. Each of these flexible support members preferably has a length and a height at least 10 times and at least 4 times respectively its average thickness. More preferably, the first and second flexible support members have an average length and an average height respectively at least 20 times and at least 6 times its average thickness. The first flexible member is preferably of a fixed size and is sufficiently long to encircle and support at least one-half of the girth of the torso. Further, this first flexible number preferably has first and second side portions that are moderately resistant to flexion in a vertical direction and sufficiently flexible in a horizontal direction to allow easy adjustment of the effective size of the backrest structure by at least about 30%, preferably 35%, or even 45% or more. The second support member is for releasably and encirclingly supporting the remainder of the girth of the torso not encircled by the first support member. The second member is preferably generally more flexible than the first member. The first and second flexible members cooperate with the fastening means to allow the effective size of the backrest structure to be easily changed to snugly encircle the torso of the person to be supported in a seated position, which thereby provides full torso support.

The frame of the backrest structure is preferably rigidly connected to both the horizontally arranged support members of the base structure and to the backrest structure, thereby attempting to hold the backrest structure in one position in spite of the forces applied thereto by the torso of the person being supported.

The optional removable tray preferably has at least one relatively large substantially planar surface, and more preferably may include a lip around the perimeter thereof for providing additional strength as well as preventing objects from rolling off of the tray. The tray may also include at least one pair of substantially vertical support members located beneath the tray for supporting the forward portion of the tray structure against downward movement. Each of these vertical members may be removably connected to the forward ends of the horizontal support members of the base structure. The tray is preferably configured so that, when in place, it obstructs the access of the person seated in the apparatus to the fastening means of the backrest structure.

According to a second aspect of the present invention, there is provided an apparatus for supporting a seated person's body by the torso, said apparatus comprising: a horizontally disposed base; a backrest assembly for providing full torso support, including means for adjusting the effective girth of the backrest assembly by at least 30%; and means, attached to said base, for adjusting the height of said backrest assembly, whereby a person may be supported by said backrest assembly at different heights. In this aspect of the invention, the means for adjusting the height of said backrest assembly preferably comprises at least one pair of spaced apart vertical support members, and a connection means for removably attaching, by hand, the pair of vertical support members to said backrest assembly and to said base, whereby the vertical support members can be replaced by vertical support members of different lengths to raise or lower the height of the backrest assembly.

In yet a further aspect and embodiment of this invention, the width of the base, as well as the backrest assembly, may be adjusted. Additional benefits and advantages of the present invention will become apparent to those skilled in the art to which this invention relates from the subsequent description of the preferred embodiments of this invention and the appended claims taken in conjunction with the accompanying drawings.

BRIEF DESCRIPTION OF THE DRAWINGS

In the drawings, like components are identified with identical reference numerals in figures FIG. 1 is a pictorial view of an adjustable body support apparatus according to this invention, showing the optional tray thereof detached from the support apparatus.

FIG. 2 is a pictorial view of the adjustable body support apparatus of FIG. 1 with the tray shown installed, and also, showing, in phantom, a user of the apparatus in a seated position.

FIG. 3 is an enlarged top view of the adjustable body support apparatus with the tray installed.

FIG. 4 a cross-sectional view taken along line 4—4 of FIG. 3, further illustrating the vertical frame members of the FIG. 1 body support apparatus.

FIG. 5 a cross-sectional view taken along line 5—5 in FIG. 3, further illustrating the construction of the tray and seat cushion of the adjustable body support apparatus.

FIG. 6 is a cross-sectional view taken along line 6—6 in FIG. 3, illustrating a portion of the tray support apparatus.

FIG. 7 is a cross-sectional view taken along line 7—7 in FIG. 5, illustrating a preferred construction of the backrest attachment for the FIG. 1 apparatus.

FIG. 8 is a view of a portion of the base of the body support apparatus incorporating a weight for increasing stability against tipping.

DETAILED DESCRIPTION OF THE PREFERRED EMBODIMENTS

An adjustable seating or body support apparatus for providing full torso support according to this invention is shown particularly by FIGS. 1, 2 and 3, and is generally designated by reference numeral 10. The support apparatus 10 includes a base 12 designed to rest on the floor or other flat surface and has a sufficiently large perimeter to prevent the support apparatus 10 from being easily tipped by the user. The base 12 includes a number of removable, elongated tubular frame members 14 namely, a lateral elongated member 15, a left rear elongated member 17, a right rear elongated member 19, a left front elongated member 21 and a right front elongated member 23. These members 14 threadably engage with elbow connecting members 16 to form a generally U-shaped configuration. The tubular members 14 have right-hand threads on one end, such as those identified at location 18 in FIG. 3. At the opposite end, tubular members 14 have left-hand threads, such as those at location 20 in FIG. 3. The right-hand male threads at location 18 engages with complementary female threads provided in connecting numbers 16. It should be appreciated that other conventional or suitable means of attaching the tubular members 14 to the connecting members 16 may be employed, such as tapered press fit connections, snapping and locking connections, etc. It is preferred that the tubular members 14 be removable without the use of tools, as is made possible by the use of threaded connections of the type shown at locations 18 and 20.

Also shown in FIG. 1 are a pair of T-shaped connectors 20 which are threaded on their inside diameter to receive and connect to elongated tube members 14. Elongated members 14, elbow members 16 and tee members 20 may be comprised of PVC tubing or other suitable material. Tee connectors 20 also each have a vertically disposed threaded portion 24 which also receives threaded male elongated members 26 which are disposed vertically, and form backrest support posts. A backrest assembly or structure 28 includes a backrest 30 which has a broad, flexible restraint strap 32 attached to it. The restraint strap 32 is preferably about three inches in height, but may range in height from about two to about four inches. The strap 32 is preferably made of a woven nylon mesh material of sufficient gage to have little (less than 5%) or no stretch when subject to forces from the person seated within the apparatus 10.

The backrest 30 and the restraint strap 32 both preferably have complementary portions of a hook and loop fastener system 34, such as the well-known Velcro fasteners, attached thereto, or more preferably a conventional plastic quick release buckle, as is further explained below. This permits easily removable engagement of the restraint strap 32 with the backrest 30 to secure the user of the body support apparatus 10. The Velcro fasteners 34 should be of sufficient width and the restraint strap 32 should overlap sufficiently with backrest 30 to provide sufficient surface area of Velcro contact to ensure that the occupant is adequately secured, even when the occupant leans to and from. Similarly, the plastic buckle should have a conventional adjustable strap. In FIG. 3, the fastener 34 is not shown tightened about the girth 33 (shown as dashed lines) of the torso of the person to be supported. Once the individual is placed in the apparatus 10, the restraint strap 32 can be quickly detached at the fastener 34 and resecured much more snugly, thereby closely surrounding and supporting the girth 33 of the torso of the person seated therein. The back portion 30*a* of the backrest 30 is preferably about 6 or 7 inches high, but may range between about 4 inches and 9 inches high, depending upon the overall size of the backrest assembly 28. The side portions 30*b* and 30*c* of the backrest 30 may be of the same height, but preferably are narrowed or tapered to a smaller height such as 2 to 4 inches, and preferably 3 inches, so as to be more flexible and less cumbersome to the person seated in the apparatus 10. The backrest assembly 28 may be provided in various sizes in order to support various size torsos. For example, one backrest assembly 28 may have an adjustable effective size from about 17 inches to about 25 ½ inches, which means that it will provide effective support for torsos having a girth at the point of contact with the person's torso ranging from about 15 inches to about 25 inches, depending upon the adjustment of the restraint strap 32. Larger and smaller size adjustable backrests are also contemplated, so that persons with an even wider range of torso sizes can be accommodated. The restraint strap 32 is preferably permanently attached by rivets, conventional adhesives or other fastening means such as stitching, to side portion 30*b* of backrest member 30.

The backrest member 30 is preferably formed of a semi-flexible plastic member 35, such as 0.125 inch thick moderate density polypropylene or polyvinylidene chloride. The significantly softer, more flexible padded member 37 is preferably formed of 0.25 inch thick plastic foam of moderate density such as closed cell polyurethane foam. The padded member 37 is preferably permanently bonded to member 30 by conventional adhesives or other sheet fastening means such as machine stitching (not shown). The backrest 30 should be flexible enough to conform to the contours of the user's torso when the restraint strap 32 is pulled snugly about the user's torso and thereafter attached to the backrest 30 by means of the Velcro fastener 34. Also, as best seen in FIG. 3, the restraint strap 32 preferably is positioned on the outside surfaces of side portions 30*b* and 30*c* in order to make the restraint strap easier to adjust and also to not chafe against the torso of the person seated in the apparatus 10 being tightened.

The backrest assembly 28 also includes a crossbar 36 which is attached to the backrest 30 by means of one or more suitable fasteners 38. As shown in FIG. 7, the fasteners 38 may be a pair of rivets, however it will be appreciated that other types of fasteners may also be employed. Backrest support bar 36, like the elongated member 14 contains threaded ends having a right hand thread 18 on one end and a left hand thread 20 on the other end as depicted in FIG. 3. The backrest crossbar 36 engages with a pair of backrest connectors 40 which are conventional threaded L type connectors similar to the connectors 16 in the base 12.

To provide increased resistance against skidding along a surface on which the body support apparatus 10 is placed, a number of pads 42 may optionally be attached by means of an adhesive to the underside of the base 12. The pads 42 may be made of compliant rubber or any other skid-resistant material.

In the preferred embodiment, a tray assembly 44 is removably attached to the base 12. Tray assembly 44 includes a rigid plastic, generally planar tray 46 which may be provided with a lip 48 around its perimeter. The tray 46 has attached to its underside a pair of T-shaped support members 50, which are secured so that the central part of the T, a single cylindrical portion, extends downwardly. The T-shaped support member 50 is threaded on its inner diameter to receive a vertical tray support 52 which is threadably attached to the T-shaped support 50. The vertical support members 52 have tapered portions 54 which permit the entire tray assembly 44 to be mounted into the body support apparatus 10 by inserting the tapered portion 54 into a pair of L-shaped connectors 56. The L-shaped connectors 56 are attached to the left front and right front base members 21 and 23. Tray assembly 44 also includes a pair of rear support hooks 58 which engage with the backrest crossbar 36 to secure the rear portion of the tray 46, as shown in FIGS. 1 and 2. In an alternative embodiment, shown in FIG. 3 the tray 46 is configured with lip 48 extended at the rear portion 60 so that it extends over backrest crossbar 36 to provide rear support for the tray assembly 44.

To provide more comfortable seating, a cushion 62 may be placed beneath the backrest 28. Cushion 62 may be constructed of a variety of soft materials including foam rubber or molded closed cell polyurethane. Cushion 62 includes recessed portion 64 which conforms with the body of the user to further increase seating comfort. Cushion 62 may also be removably attachable to the base 12 via a pair of support members 66 conventionally attached to its underside which extend between left front and right front base members 21 and 23. The support members 66 have semicylindrical plastic spring clip members attached to each end which engage with base members 21 and 23 to secure the seat 62 to the base 12. Alternatively, nylon straps having Velcro fasteners at the ends thereof could be used as support members 66 if desired with each of the straps simply encircling the base members 21 and 23.

While the base 12 is sufficiently wide and long to ensure against tipping, additional stability may be provided by means of weights. As shown in FIG. 3, a weight rod or bar 70 may be inserted into the rear base support member 15 or any other of the tubular horizontal members forming part of the base 12. Weight bar 70 may be constructed of a suitable, high density material such as iron, sand encased in a plastic tube, and the like. Alternatively, as shown in FIG. 8, triangular metal weight portions 72 may be attached to the top side of the base connectors 16.

The various tubular members of the base 12, the tray structure 44 and the frame supporting the backrest 30 may be sealed or filled with a water resistant foam so as to not trap water. Further, all components of the apparatus 10 are preferably made of water-proof or water resistant materials so that the apparatus 10 may be used in environments where water is present, such as bathtubs, sandboxes, lawns and the like.

The body support apparatus 10 may be used in a number of configurations. In its most simplest form, the body support apparatus comprises the base 12 and the backrest assembly 28 which may be placed in a bathtub or other suitable surface for seating when it is desired to support and restrain the mobility of a person in a seated position. The user/occupant 74 may sit on the floor surface while the base assembly 12 with backrest 28 attached is slid from behind until the backrest touches the back of the user 74. The restraint strap 32 is then wrapped around the user 74 and attached to the backrest 30 by means of a pair of Velcro strips 34 or plastic quick release buckle. One such conventional plastic quick release buckle is available from Danmar Products Inc., Ann Arbor, Mich. (Model No. 4165). The body support apparatus will then support the user/occupant 74 from falling over or from getting up and moving about. For example, this may be desired while the occupant 74 is in a bathtub taking a bath.

To support the user 74 in any desired seating position, the vertical backrest supports 26 may be removed by rotating them which will unscrew the left hand and right hand threads on either end until it is disengaged from the backrest connectors 40 and the T-shaped connectors 22. Longer vertical support members 26 may then be substituted by inserting the ends into the T-shaped connector 22 and the backrest connector 40 and rotating until the threads are completely engaged. Depending on the length of the longer vertical supports 26, the different size users 74 may now be comfortably supported.

To change the dimensions of the perimeter of the base 12, to thereby increase stability for raised positions, or to accommodate larger persons, varying lengths of base members 14 may be substituted. This is accomplished by rotating any of the base members 14 to disengage the threads on both ends, such as threads 18 and 20 shown in FIG. 3. The substituted base member 14 may then be reinserted into the base into the same manner by inserting into the connectors 16 and rotating the new base member 14 in an opposite direction until its threads are completely engaged with those in the connector 16. In this way, the width and the length of the base 12 can be adjusted, limited only by the lengths of base members 14 available. It should be noted that when the length of the rear base member 15 is changed, the backrest horizontal member 36 will also have to changed to a length which corresponds to the new base horizontal or rear member 15. This is required to insure that the backrest vertical supports 26 line up with the T connector 22. To replace the backrest crossbar 36, the entire backrest 30 will also have to be replaced if a permanent connection such as the rivet 38 shown in FIG. 7 is employed. Alternatively, a removable connection may be used which would permit substituting various lengths of the backrest crossbar 36 while using the same backrest 30.

While the base 12 and backrest assembly 28 may be used alone, in the preferred embodiment as shown in FIG. 1 through 5, the body support apparatus 10 may be used with a tray assembly 44. To use the tray 44, the user 74 is first placed into the seat 30 with the restraint strap 32 connected. The tray 44 is then placed over the base 12 until tapered portions 54 line up and are inserted into the connectors 56. Tapered portions 54 permit the tray 44 to be easily lifted off when it is desired to remove the user 74 or to use the body support apparatus without a tray. The tray 44 provides additional support to the user 44 as well as providing a surface on which to conduct various activities such as playing, drawing, eating, etc. Another advantage of the tray is that when in position it substantially obstructs access to the fastener system 34, so that the user thereof cannot inadvertently unfasten himself or herself.

To accommodate a user 74 as he grows, or to accommodate users of different sizes, the height of the tray 44 may be varied by substituting vertical support members 52 for longer members. This may be accomplished simply by unscrewing the vertical support members 52 into the tray T connectors 50. It will be appreciated that when a higher tray level is used by means of longer vertical members 52, the backrest vertical supports 26 will have to be changed to longer lengths so that the tray lip supports 58 will engage with the backrest crossbar 36 maintaining a level position of the tray. Trays of different sizes may also be substituted for the tray 44 thereby accommodating different uses as well as users 74 of different sizes. This may require changing the left front and right front base members 21 and 23 to accommodate a longer or shorter tray 44. It will be appreciated that as an alternative means for adjusting the size of various portions of the adjustable body support apparatus 10, base members 14, vertical backrests members 26 and tray members 52, may all incorporate telescoping tubes which each comprise a pair of telescoping tube sections that are secured by means of a conventional rotatable ring tightening mechanism.

In an additional alternative embodiment, some of the base or backrest support portions of the body support apparatus 10 may be constructed using long pieces of metal with straight sections and bent sections, thereby obviating the need to use the L-shaped connectors 16. While the above description explains in detail the preferred embodiments of the present invention, it will be appreciated that the invention is susceptible to modification, variation and change without departing from the proper scope and fair meaning of the accompanying claims.

I claim:

1. An adjustable seating apparatus for supporting a person in a seated position with full torso support, the apparatus comprising:

a base structure adapted to rest on a substantially planar support surface, the base structure including a plurality of first elongated substantially horizontally arranged support members spaced apart from one another;

a backrest structure for adjustably and encirclingly supporting a torso of a seated person;

a frame for supporting the backrest structure, said frame being rigidly connected to both of the horizontally arranged support members of the base structure and to the backrest structure; and a removable tray structure for providing a play surface for a seated person whose torso is supported by the apparatus said tray structure having at least one relatively large substantially planar surface, and at least one pair of spaced apart substantially vertical support members located beneath the tray and supporting the forward portion of the tray structure against downward movement, each of said vertical members being removably connected to the horizontal support members of the base structure;

the plurality of first support members of the base structure being spaced apart from one another, and extending forwardly and rearwardly of the frame, thereby preventing the apparatus from tipping in either a forward or rearward direction;

the backrest structure including first and second broad flexible support members and fastening means for releasably fastening the support members together about a torso of a person to be supported, each of the flexible support members having a length and a height at least ten times and at least four times respectively its average thickness, the first flexible member being of a fixed size and sufficiently long to encircle at least about one-half of a maximum inner girth of the backrest structure and having first and second side portions that are moderately resistant to flexion in a vertical direction and sufficiently flexible in a horizontal direction to allow easy adjustment of the effective inner girth of the backrest structure, and the second support member being for releasably and encirclingly the remaining portion of the inner girth of the backrest structure not encircled by the first support member, said second member being generally more flexible than the first member, the first and second flexible members cooperating with the fastening means to allow the inner girth of the backrest structure to be easily changed up to about fifty percent, whereby torsos of persons in a seated position which vary widely in girth can be snugly encircled by the backrest structure, thereby providing full torso support for such seated persons.

2. The apparatus according to claim 1 wherein:

the first flexible support member of the backrest structure includes a flexible structural member made of strong plastic sheet material having inner and outer surfaces an average length and an average height respectively at least twenty times and at least six times its average thickness, and much softer padding material attached to and covering substantially all of the inner surface of the flexible structural member such that the first flexible support member of the backrest structure has a relatively soft padded surface presented to the torso of a person supported by the apparatus; and the second broad flexible support member is configured as a broad strap of pliant nonmetallic material connected at opposite end portions thereof along the outside surfaces of the first and second side portions of the first flexible support member, such that when the second broad support member is drawn in so as to reduce the effective circumference of the backrest structure, the second flexible support member holds the first member in a state characterized by radially inward, substantially equiangular flexion of each of the side portions of the first flexible member.

3. The apparatus according to claim 2, wherein:

the substantially horizontal support members of the base structure each have a middle portion, a tubular portion extending forwardly from its middle portion and a tubular portion extending rearwardly from its middle portion, the frame being connected to and supported by a respective one of the middle portions, and the frame includes a horizontal structure member and means for adjusting the height of the backrest structure, said adjusting means including a plurality of elongated substantially vertical tubular support members each removably attached at one end thereof to the horizontal structure member and at the other end thereof to a respective one of the middle portions of the horizontal support members, in which said vertical tubular support members are replaceable with another plurality of vertical tubular support members of different length, thereby adjusting the height of the backrest structure relative the base structure.

4. An apparatus for seating and supporting a seated person's body, said apparatus comprising:

horizontally disposed base adapted to rest on a stationary planar surface;

a backrest assembly for supporting a seated person's body at the torso, including first and second broad flexible support members, fastening means for adjustably and releasably securing the first and second broad flexible support members together to form an inner circumference having an annular shape so as to encircle a seated person to be supported about the torso, each of the flexible support members having a length and a height at least ten times and at least four times respectively its average thickness, the first flexible member being of a fixed size and sufficiently long to encompass at least one-half of said inner circumference, whereby it will encircle and support at least about one-half of the girth of the torso and the first flexible member also having first and second side portions that are moderately resistant to flexion in a vertical direction and sufficiently flexible in a horizontal direction to allow easy adjustment of the inner circumference of the backrest structure, and the second support member being arranged to form the remainder of said inner circumference whereby said second support member will releasably and encircling support the remainder of the girth of the torso not encircled by the first support member, said second member being generally more flexible than the first member, the first and second flexible members cooperating with the fastening means to allow the inner circumference of the backrest structure to be easily changed by hand over a range of up to about fifty percent, thereby enabling the backrest structure to be manually adjusted so as to snugly encircle the torso of the seated person to be supported, and thereby provide full torso support;

means for adjusting the height of said backrest assembly, attached to said backrest assembly and to said base, including at least one pair of vertical support members removably attached to said backrest assembly, and also removably attached to said base, wherein said vertical support members can be replaced by vertical support members of different lengths to raise or lower the height of the backrest; and means for adjusting the width of said apparatus.

5. The apparatus according to claim 4 wherein said means for adjusting the width of said apparatus further comprises a plurality of elongated means, including a first elongated member being removably attached to said base and a second elongated member being attached to said backrest assembly and also removably attached to said means for adjusting the height of said backrest assembly, wherein said first and second elongated members can be substituted for elongated members having different lengths to change the width of said apparatus.

6. The apparatus of claim 4 further comprising tray means having brackets removably engaged with said backrest assembly and also removably attached to said base means, said tray means including a substantially horizontally disposed planar member.

7. The apparatus according to claim 6 further comprising means for adjusting the height of said tray means including at least one pair of vertical support members removably attached to said tray means and also to said base, wherein said pair of vertical support members can be substituted with vertical support members of different lengths to raise or lower the height of the tray means.

8. The apparatus of claim 4 further comprising seat means attached to said base.

9. An apparatus for supporting a seated person by the torso so as to maintain such person in an upright position, said apparatus comprising:

a horizontally disposed base;

a backrest assembly for providing full torso support, including at least first flexible member and means for adjusting the inner girth of the backrest assembly, the first flexible member being of a fixed size and sufficiently long to encircle at least about one-half of a maximum inner girth of the backrest assembly, and having first and second side portions that are moderately resist to flexion in a vertical direction and sufficiently flexible in a horizontal direction to allow easy manual adjustment of the inner girth of the backrest assembly over a range of at least about thirty percent, the first flexible member cooperating with the fastening means to allow the inner girth of the backrest assembly to be easily changed by hand to snugly encircle a torso of a person to be supported in a seated position, thereby providing full torso support;

means, attached to said base, for adjusting the height of said backrest assembly, whereby a person may be supported by said backrest assembly at different heights; and tray means having brackets removably engaged with said backrest assembly and also removably attached to said base, said tray means including a substantially horizontally disposed planar member.

10. The apparatus of claim 9 further comprising seat means attached to said base.

11. An apparatus for supporting a seated person by the torso so as to maintain such person in an upright position, said apparatus comprising:

a horizontally disposed base;

a backrest assembly for providing full torso support, including at least first flexible member and means for adjusting the inner girth of the backrest assembly, the first flexible member being of a fixed size and sufficiently long to encircle at least about one-half of a maximum inner girth of the backrest assembly and having first and second side portions that are moderately resistant to flexion in a vertical direction and sufficiently flexible in a horizontal direction to allow easy manual adjustment of the inner girth of the backrest assembly over a range of at least about thirty percent, the first flexible member cooperating with the fastening means to allow the inner girth of the backrest assembly to be easily changed by hand to snugly encircle a torso of a person to be supported in a seated position, thereby providing full torso support;

means, attached to said base, for adjusting the height of said backrest assembly, whereby a person may be supported by said backrest assembly at different heights;

tray means having brackets removably engaged with said backrest assembly and also removably attached to said base, said tray means including a substantially horizontally disposed planar member; and means for adjusting the height of said tray means including at least one pair of vertical support members removably attached to said tray means and also to said base, wherein said pair of vertical support members can be substituted with vertical support members of different lengths to raise or lower the height of the tray means.

12. An apparatus for supporting a small person, such as a handicapped child or an infant, by his or her torso in a seated position so that such a person may sit upright, said apparatus comprising:

a base for use on a substantially flat support surface, the base having a central support structure and a plurality of support members extending substantially horizontally outwardly from the central support structure in a manner which tends to prevent the base from tipping over;

a backrest assembly for providing full torso support, including at least a first flexible member and manually releasable fastening means for adjusting the effective inner girth of the backrest assembly, the first flexible member being sufficiently long in a horizontal direction to encircle at least about one-half of a maximum inner girth of the backrest assembly, the first flexible member having first and second side portions that are moderately resistant to flexion in a vertical direction and sufficiently flexible in preselected horizontal directions to allow easy manual adjustment of the effective inner girth of the backrest structure, the first flexible member cooperating with the releasable fastening means to allow the inner girth of the backrest structure to be easily and manually changed to snugly encircle a torso of such a person to be supported in a seated position, thereby providing full torso support to such seated person;

wherein the backrest assembly further includes, a second broad flexible elongated support member having first and second end portions each attached to different portions of the first flexible member, the first and second flexible support members each having a length and a height at least ten times and at least four times respectively of its average thickness, the first member being of a fixed size and sufficiently long to encircle and support at least about one-half of the maximum inner girth of the backrest assembly, and wherein the second support member is arranged to releasable and encirclingly support the remaining the girth of the torso not encircled by the first support member, and the second flexible member is generally more flexible than the first member.

* * * * *